US012318704B1

(12) United States Patent
Peterson

(10) Patent No.: US 12,318,704 B1
(45) Date of Patent: Jun. 3, 2025

(54) MAGNETIC JOINT

(71) Applicant: Adam Joel Peterson, Fargo, ND (US)

(72) Inventor: Adam Joel Peterson, Fargo, ND (US)

( * ) Notice: Subject to any disclaimer, the term of this patent is extended or adjusted under 35 U.S.C. 154(b) by 0 days.

(21) Appl. No.: 18/642,543

(22) Filed: Apr. 22, 2024

(51) Int. Cl.
*A63H 3/46* (2006.01)

(52) U.S. Cl.
CPC ..... *A63H 3/46* (2013.01)

(58) Field of Classification Search
None
See application file for complete search history.

(56) References Cited

U.S. PATENT DOCUMENTS

| | | | | |
|---|---|---|---|---|
| 3,246,422 | A | 4/1966 | Teagarden | |
| 4,038,775 | A | 8/1977 | Sato | |
| 4,118,888 | A | 10/1978 | Ogawa | |
| 5,277,643 | A | 1/1994 | Ejima | |
| 7,520,793 | B2 | 4/2009 | Pillai et al. | |
| 8,684,783 | B2 * | 4/2014 | Ehrsam | G09F 19/08 446/139 |
| 9,566,531 | B2 | 2/2017 | Hacking | |
| 9,782,687 | B2 * | 10/2017 | Bagley | A63H 33/046 |
| 10,232,276 | B2 * | 3/2019 | Hacking | A63H 3/46 |
| 11,241,634 | B2 | 2/2022 | Lawber | |
| 2006/0178081 | A1 | 8/2006 | Daftari et al. | |

FOREIGN PATENT DOCUMENTS

| | | | | | |
|---|---|---|---|---|---|
| CN | 210645110 | U | | 6/2020 | |
| CN | 213077472 | U | | 4/2021 | |
| CN | 219539420 | U | | 8/2023 | |
| DE | 102005018755 | A1 | * | 10/2006 | A63H 33/046 |
| DE | 102009040569 | A1 | * | 3/2011 | A63H 13/005 |
| JP | H0623153 | A | | 2/1994 | |
| JP | 2000140447 | A | | 5/2000 | |
| JP | 2015033563 | A | * | 2/2015 | |
| JP | 2018122071 | A | | 8/2018 | |
| JP | 2019134879 | A | | 8/2019 | |
| KR | 20070067979 | A | * | 6/2007 | |
| KR | 20110004536 | A | * | 1/2011 | |
| KR | 20140069758 | A | * | 6/2014 | |
| KR | 101421585 | B1 | * | 7/2014 | |
| KR | 101450395 | B1 | * | 10/2014 | |
| KR | 20140117806 | A | * | 10/2014 | |
| KR | 200480996 | Y1 | * | 8/2016 | |
| KR | 20200030247 | A | * | 3/2020 | |
| WO | 2007128999 | A2 | | 11/2007 | |

* cited by examiner

*Primary Examiner* — Jonathan P Masinick
(74) *Attorney, Agent, or Firm* — Fargo Patent & Business Law; Thomas Kading

(57) ABSTRACT

A magnetic joint includes a first component having a first interface; a second component having a second interface; a first magnet adjacent to the first interface; and a spherical magnet within a cavity formed in the second component, the cavity adjacent to the second interface, the spherical magnet movable within the cavity such that the spherical magnet is attracted to the first magnet to retain the first component to the second component such that the second component is articulatable with respect to the first first component.

14 Claims, 4 Drawing Sheets

MAGNETIC JOINT

CROSS REFERENCE TO RELATED APPLICATION[S]

None

BACKGROUND

The present disclosure relates to articulatable and removable appendages, and more particularly to an articulatable figure having magnetic joints.

Joints of various designs have been developed for figurines to permit the selective attachment and removal of component parts, such as appendages. Whilst existing joint designs may allow for articulation of appendages, such designs typically require a direct connection mechanical arrangement that may be susceptible to breakage and limited movement.

SUMMARY

A magnetic joint according to one disclosed non-limiting embodiment of the present disclosure includes a first component having a first interface; a second component having a second interface; a first magnet adjacent to the first interface; and a spherical magnet within a cavity formed in the second component, the cavity adjacent to the second interface, the spherical magnet movable within the cavity such that the spherical magnet is attracted to the first magnet to retain the first component to the second component such that the second component is articulatable with respect to the first first component.

A further embodiment of any of the foregoing embodiments of the present disclosure includes that the second interface at least partially fits within the first interface.

A further embodiment of any of the foregoing embodiments of the present disclosure includes that the cavity is conformal with respect to the second interface.

A further embodiment of any of the foregoing embodiments of the present disclosure includes that the cavity is non-spherical.

A further embodiment of any of the foregoing embodiments of the present disclosure includes that the cavity is ovaloid in shape.

A further embodiment of any of the foregoing embodiments of the present disclosure includes that the cavity is rectilinear in shape.

A further embodiment of any of the foregoing embodiments of the present disclosure includes that the cavity is non-spherical.

A further embodiment of any of the foregoing embodiments of the present disclosure includes that the first component is a first bone and the second component is a second bone adjacent to the first bone.

A further embodiment of any of the foregoing embodiments of the present disclosure includes that the first component and the second component are adjacent components of an articulatable figure.

A further embodiment of any of the foregoing embodiments of the present disclosure includes that the first component and the second component are adjacent components of a skeleton.

A magnetic joint for an articulatable figure according to one disclosed non-limiting embodiment of the present disclosure includes a first component having a first interface; a second component having a second interface, the second interface adjacent to the first interface the second component an articulatable portion of the articulatable figure; a first magnet adjacent to the first interface; and a spherical magnet within a cavity formed in the second component, the cavity adjacent to the second interface, the spherical magnet movable within the cavity such that the spherical magnet is attracted to the first magnet to retain the first component to the second component such that the second component is articulatable with respect to the first first component.

A further embodiment of any of the foregoing embodiments of the present disclosure includes that the first component is a torso and the second component is an arm.

A further embodiment of any of the foregoing embodiments of the present disclosure includes that the first component is a torso and the second component is a leg.

A further embodiment of any of the foregoing embodiments of the present disclosure includes that the first component is an upper leg thigh and the second component is a lower leg.

A further embodiment of any of the foregoing embodiments of the present disclosure includes that the first component is an upper arm and the second component is a forearm.

A further embodiment of any of the foregoing embodiments of the present disclosure includes that the second interface at least partially fits within the first interface.

A magnetic joint for a skeleton according to one disclosed non-limiting embodiment of the present disclosure includes a first bone having a first interface; a second bone having a second interface, the second interface adjacent to the first interface, the second bone an articulatable portion of the skeleton; a first magnet adjacent to the first interface; and a spherical magnet within a cavity formed in the second bone, the cavity adjacent to the second interface, the spherical magnet movable within the cavity such that the spherical magnet is attracted to the first magnet to retain the first bone to the second bone such that the second bone is articulatable with respect to the first first bone.

A further embodiment of any of the foregoing embodiments of the present disclosure includes that the first bone and the second bone are synthetic.

A further embodiment of any of the foregoing embodiments of the present disclosure includes that the cavity is at least partially conformal with respect to the second interface.

A further embodiment of any of the foregoing embodiments of the present disclosure includes that the cavity is non-spherical.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
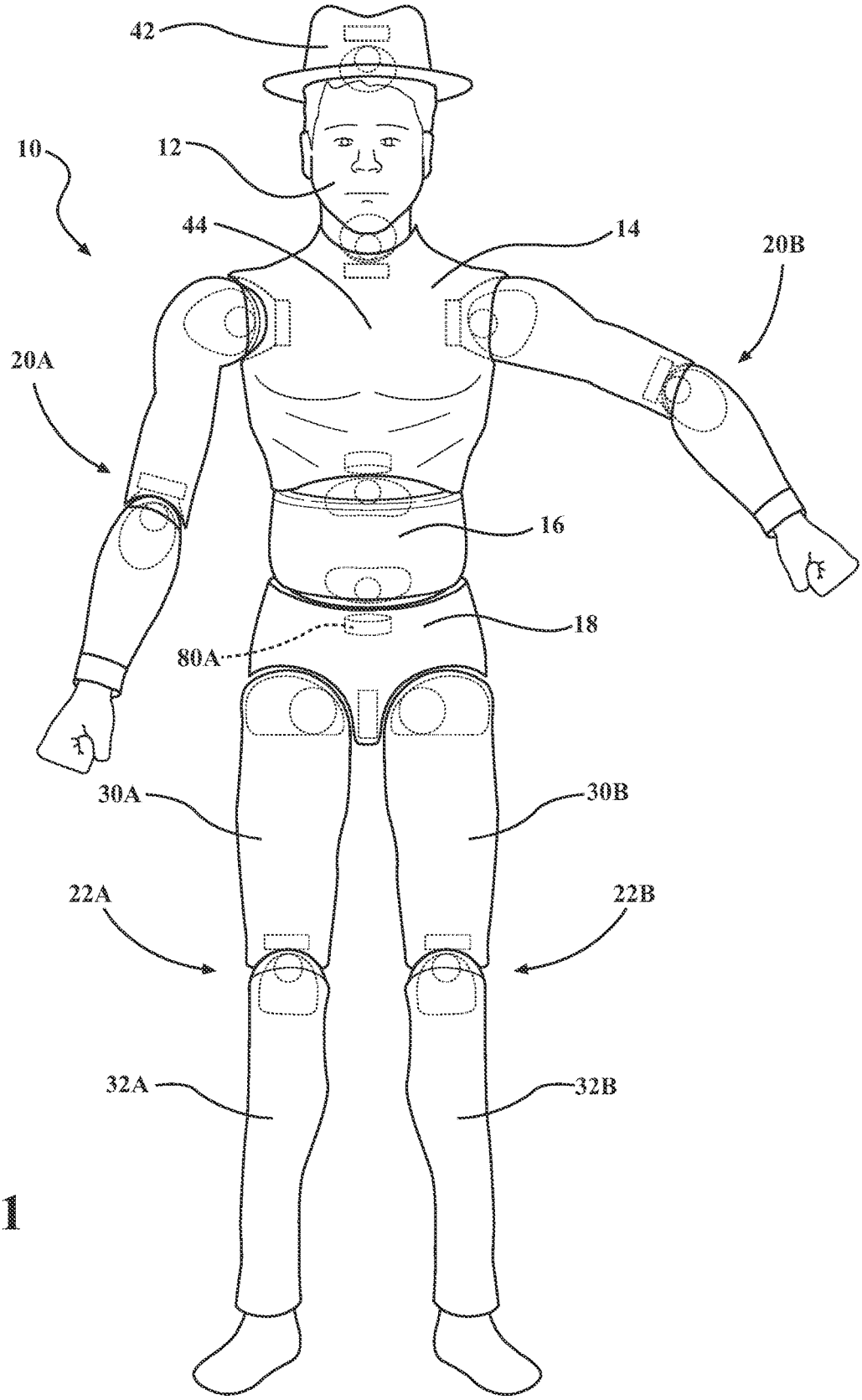
FIG. 1 is a schematic partial phantom view of an articulatable figure according to one disclosed non-limiting embodiment.
Figure 2:
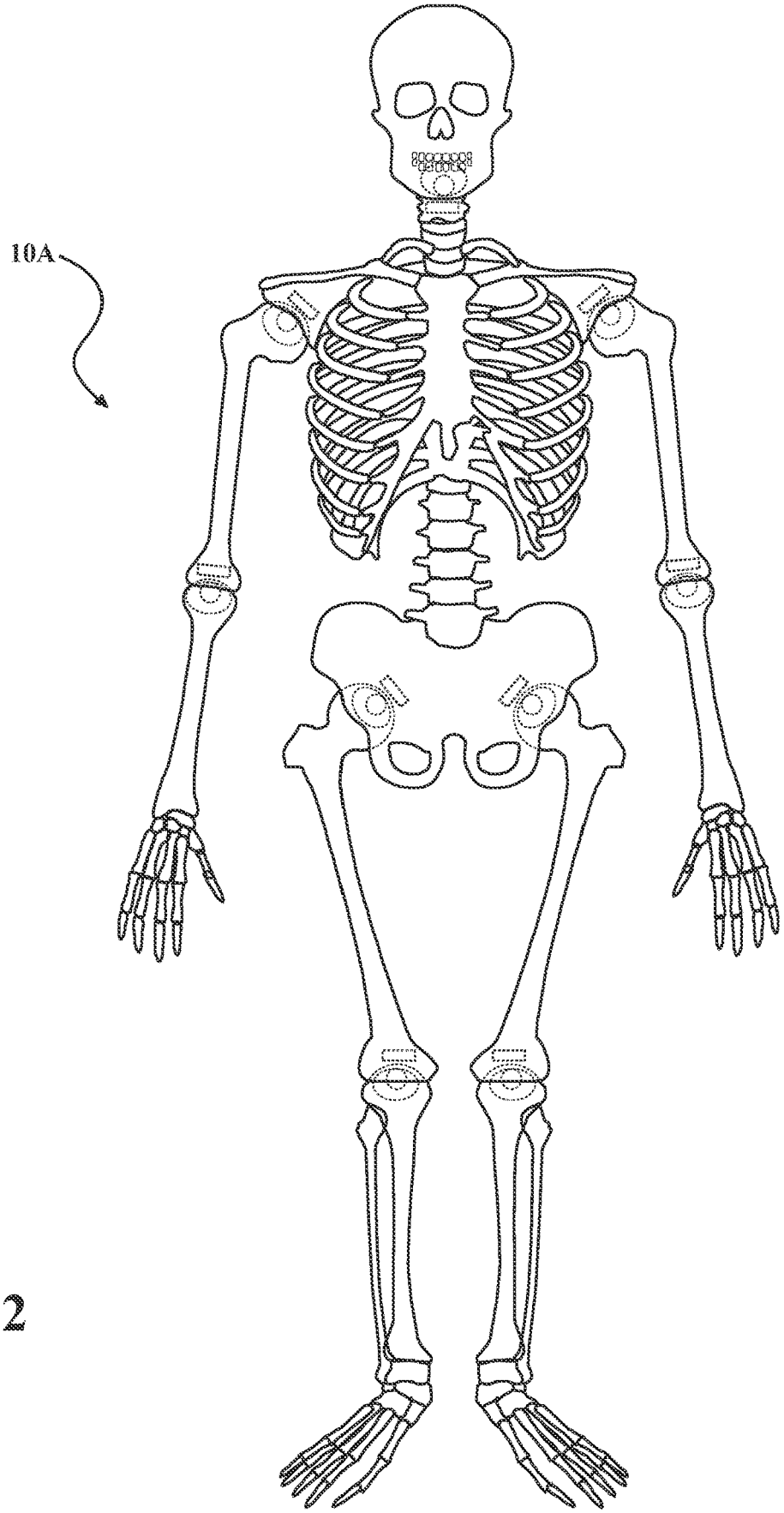
FIG. 2 is a schematic view of an articulatable skeleton according to one disclosed non-limiting embodiment.

FIG. 1 schematically illustrates an articulatable FIG. 10. The articulatable FIG. 10 may be, in one embodiment a toy such as a humanoid-like figure, a doll, an animal, a robot, a battle mech, etc. In other embodiments, the articulatable FIG. 10A (FIG. 2) may be a human or animal skeleton (FIG. 2) with real and/or synthetic bones that illustrate articulation of the joints which may be usable in a learning or other such environment.

Figure 3:
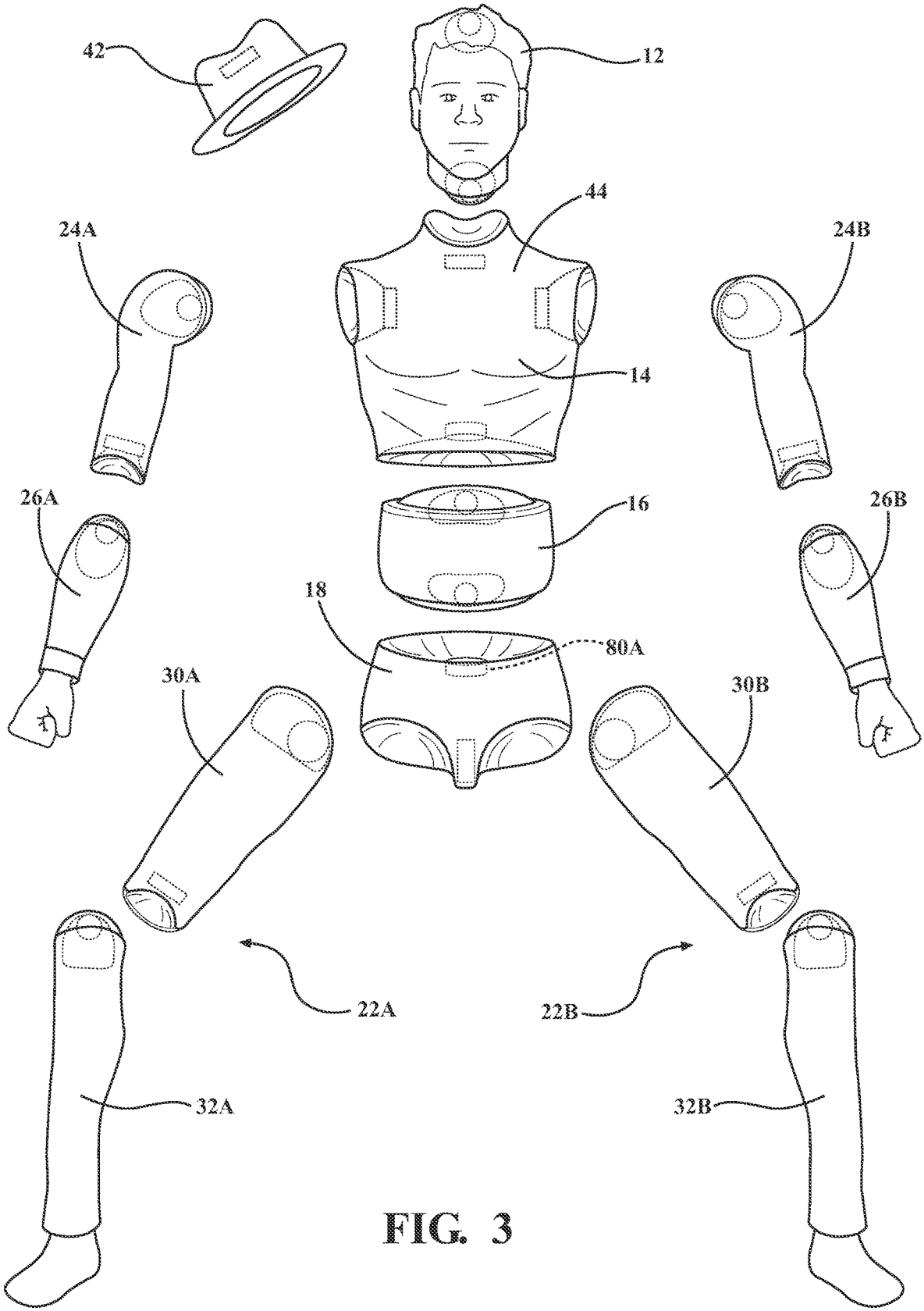
FIG. 3 is an exploded view of the articulatable figure of FIG. 1 according to one disclosed non-limiting embodiment.
Figure 4:
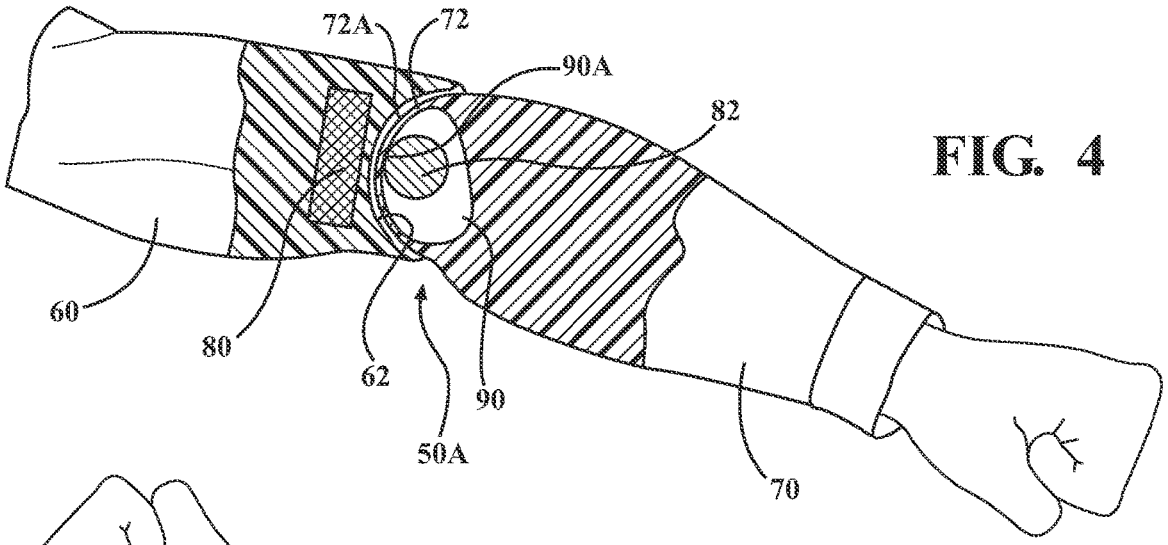
FIG. 4 is an exploded view of an example magnetic joint of the articulatable figure according to one disclosed non-limiting embodiment.

With reference to FIG. 3, in one embodiment, the articulatable FIG. 10 includes a head 12, an upper torso 14, a lower torso 16, a pelvis 18, arms 20A, 20B, and legs 22A, 22B. Each arm 20A, 20B may include an upper arm 24A, 24B, and a forearm 26A, 26B. Each leg 22A, 22B may include a thigh 30A, 30B and a lower leg 32A, 32B. One or more of the foregoing components are movably coupled to their adjoining components by magnetic joints 50A-50*n* (FIG. 4). Although a particular segregation of parts are illustrated in this embodiment, other parts and or components such as a hat 42 and jacket 44 may alternately or additionally be provided with a magnetic joint.

With reference to FIG. 4, a representative magnetic joint 50A includes a first component 60 having a first interface 62, a second component 70 having a second interface 72, a first magnet 80, and a spherical magnet 82 within a cavity 90. In one embodiment, the first magnet 80 and the spherical magnet 82 may be Neodymium Rare Earth magnets. When coupled, the magnets 80, 82 are effectively hidden from view yet movably retain the components 60, 70 together while allowing for a wide range of articulation as the components 60, 70 are movable around the interior spherical magnet 82 which is freely movable within the cavity 90. By appropriately sizing the magnets 80, 82, various components may be readily joined, e.g., leg bones, finger bones, etc.

The first component 60 and the second component 70 may be adjacent components such as the head 12, the upper torso 14, the lower torso 16, the pelvis 18, the arms 20A, 20B, the legs 22A, 22B, etc. The first interface 62 and the second interface 72 may be a male-female type arrangement such that, for example, the second interface 72 at least partially fits within the first interface 62 to facilitate assembly and articulation of the articulatable FIG. 10.

The first magnet 80 may be affixed within the first component 60 adjacent to the first interface 62. The first magnet 80 may, in one example, be a cylindrical magnet that is inserted through the first interface 62. The first magnet 80 may be partially exposed at the first interface 62 or may be completely hidden within the first component 60.

The interior sphere magnet 82 freely movable within the cavity 90 within the second component 70 adjacent to the second interface 72. That is, the cavity 90 is formed within the second component 70 adjacent to the second interface 72 such that the interior spherical magnet 82 may magnetically engage with the first magnet 80 as the first interface 62 is adjacent to the second interface 72.

Figure 5:
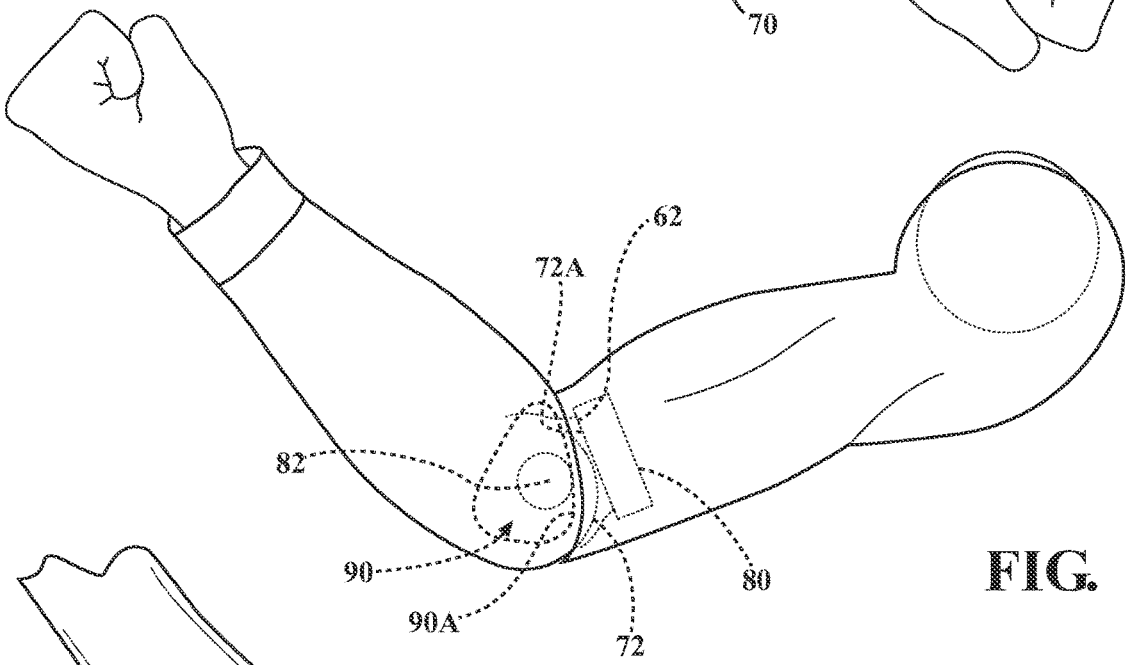
FIG. 5 is an assembled view of the example magnetic joint of FIG. 4 in an example articulated position.

In one embodiment, the cavity 90 is formed within the second component 70 such that the cavity 90 is conformal with respect to the second interface 72. The spherical magnet 82 is movable within the cavity 90 such that the spherical magnet 82 is attracted to the first magnet 80 to retain the first component 60 to the second component 72 whilst the second component 72 is articulatable with respect to the first component 60 (FIG. 5). In some embodiments, the first magnet 80 in some particular locations, such as that within the top of the pelvis 18, may be a metal alloy 80A rather than a magnet to mitigate any polarity interference to, for example, attach to the lower spherical magnet 82 in the lower torso.

The cavity 90, although adjacent to the second interface 72 may be completely hidden within the second component 70. The cavity 90 may be non-circular, e.g., ovaloid, rectilinear, etc., in cross-section such that at least a portion 90A of the cavity 90 generally follows the shape of at least a portion 72A of the second interface 72 and is of a size to permit movement of the interior spherical magnet 82 therein. The magnetic joint 50A provides a virtually limitless range of movement as the cavity 90 permits movement of the interior spherical magnet 82 to remain magnetically attracted to the first magnet 80. If extended beyond the mechanical limit of the interface 62, 72, the magnetic joint 50A either holds due to the magnetic attraction or disconnects the joint entirely without loss of the magnets themselves.

Figure 6:
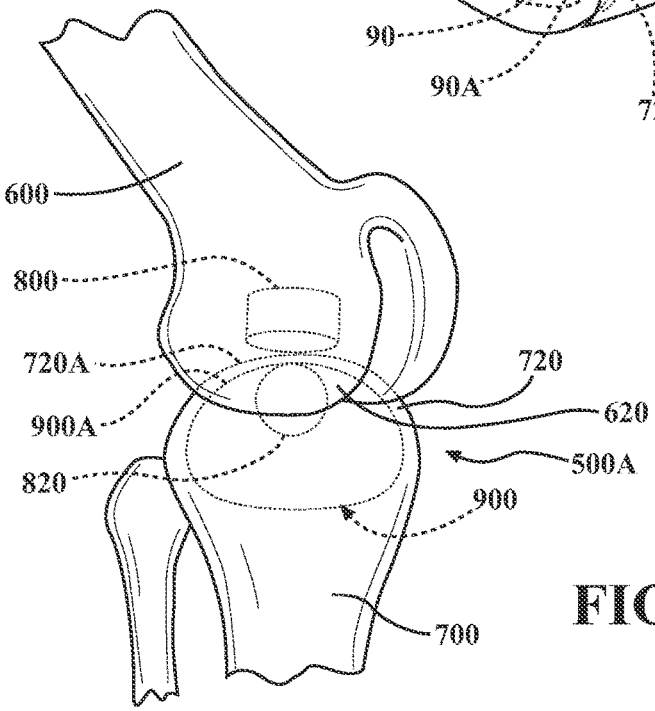
FIG. 6 is an assembled view of an example magnetic joint for a skeleton structure according to another disclosed non-limiting embodiment.

With reference to FIG. 6, another embodiment of a magnetic joint 500A such as an example knee structure may include a first component 600 and a second component 700 that are actual bones or synthetic bones such that an interface 620, 720 are formed by the actual bone interface rather than a simple male-female interface that may be more appropriate for appendages of a toy figure. That is, the bones of the skeleton may form the actual interface 620, 720. The cavity 900 may include a portion 900A that generally follows and conforms to the shape of at least a portion 720A of the second interface 720. The cavity 900 may be of a size to permit movement of an interior spherical magnet 820 yet maintain a magnetic attraction to the magnet 800 to permit movement of the bones in a realistic manner. Since the magnetic joint 500A for a skeleton that uses actual bones may likely be used for teaching rather than play, a more delicate, i.e., easily disassembled joint may be acceptable.

The magnetic joints are fun and easy to use for children, those with physical limitations, disabilities and special needs while also being an enjoyable, customizable toy for the masses. The magnetic joints may also be usable to construct skeletons and other structures which provide a cleaner and more representative posable joint without the heretofore requirements of pins, screws, wires, etc.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A magnetic joint, comprising:

a first component having a first interface;

a second component having a second interface;

a first magnet adjacent to the first interface; and a spherical magnet within a non-spherical cavity formed in the second component, the non-spherical cavity adjacent to the second interface and is conformal with respect to the second interface, the second interface at least partially fits within the first interface and the spherical magnet movable within the non-spherical cavity such that the spherical magnet is attracted to the first magnet to retain the first component to the second component such that the second component is articulatable with respect to the first component.

2. The magnetic joint as recited in claim 1, wherein the first component is a first bone and the second component is a second bone adjacent to the first bone.

3. The magnetic joint as recited in claim 1, wherein the first component and the second component are adjacent components of an articulatable figure.

4. The magnetic joint as recited in claim 1, wherein the first component and the second component are adjacent components of a skeleton.

5. The magnetic joint as recited in claim 1, wherein the first magnet is partially exposed at the first interface.

6. The magnetic joint as recited in claim 1, wherein the first magnet is completely hidden within the first component.

7. A magnetic joint for an articulatable figure, comprising:

a first component having a first interface;

a second component having a second interface, the second interface adjacent to the first interface the second component an articulatable portion of the articulatable figure;

a first magnet adjacent to the first interface; and a spherical magnet within a non-spherical cavity formed in the second component, the non-spherical cavity adjacent to the second interface and conformal with respect to the second interface, the spherical magnet movable within the non-spherical cavity such that the spherical magnet is attracted to the first magnet to retain the first component to the second component such that the second component is articulatable with respect to the first component.

8. The magnetic joint as recited in claim 7, wherein the first component is a torso and the second component is an arm.

9. The magnetic joint as recited in claim 7, wherein the first component is a torso and the second component is a leg.

10. The magnetic joint as recited in claim 7, wherein the first component is thigh and the second component is a lower leg.

11. The magnetic joint as recited in claim 7, wherein the first component is an upper arm and the second component is a forearm.

12. The magnetic joint as recited in claim 7, wherein the second interface at least partially fits within the first interface.

13. A magnetic joint for a skeleton, comprising:

a first bone having a first interface;

a second bone having a second interface, the second interface adjacent to the first interface, the second bone an articulatable portion of the skeleton;

a first magnet adjacent to the first interface; and a spherical magnet within a non-spherical cavity formed in the second bone, the non-spherical cavity adjacent to the second interface and conformal with respect to the second interface, the spherical magnet movable within the non-spherical cavity such that the spherical magnet is attracted to the first magnet to retain the first bone to the second bone such that the second bone is articulatable with respect to the first bone.

14. The magnetic joint as recited in claim 13, wherein the first bone and the second bone are synthetic.

* * * * *